US007640623B2

(12) United States Patent
Jung et al.

(10) Patent No.: US 7,640,623 B2
(45) **Date of Patent: *Jan. 5, 2010**

(54) VACUUM CLEANER

(75) Inventors: Jae Duck Jung, Changwon-si (KR); Il Gyeong Go, Jinhae-si (KR); Young Gun Min, Changwon-si (KR); Hyung Il Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 824 days.

This patent is subject to a terminal disclaimer.

(21) Appl. No.: 10/944,195

(22) Filed: Sep. 20, 2004

(65) Prior Publication Data

US 2005/0198765 A1 Sep. 15, 2005

(30) Foreign Application Priority Data

| | | |
|---|---|---|
| Mar. 11, 2004 | (KR) | 10-2004-0016477 |
| Mar. 11, 2004 | (KR) | 10-2004-0016478 |
| Mar. 11, 2004 | (KR) | 10-2004-0016481 |
| Apr. 9, 2004 | (KR) | 10-2004-0024411 |

(51) Int. Cl.
*A47L 9/10* (2006.01)

(52) U.S. Cl. ..... 15/352; 15/349; 15/353

(58) Field of Classification Search ..... 15/349, 15/350, 352, 353; 55/428, 429
See application file for complete search history.

(56) References Cited

U.S. PATENT DOCUMENTS

| | | | | |
|---|---|---|---|---|
| 5,388,301 | A * | 2/1995 | Bosyj et al. | 15/327.1 |
| 6,521,006 | B2 * | 2/2003 | Park et al. | 55/337 |
| 6,626,973 | B2 * | 9/2003 | Park | 55/480 |
| 6,640,385 | B2 * | 11/2003 | Oh et al. | 15/352 |
| 6,775,882 | B2 * | 8/2004 | Murphy et al. | 15/352 |
| 2003/0066156 | A1 * | 4/2003 | Yang | 15/327.2 |
| 2003/0233817 | A1 * | 12/2003 | Park | 55/337 |
| 2004/0064912 | A1 * | 4/2004 | Ji et al. | 15/352 |
| 2004/0177472 | A1 * | 9/2004 | Go et al. | 15/353 |
| 2005/0005392 | A1 * | 1/2005 | Jeong | 15/353 |
| 2005/0198767 | A1 * | 9/2005 | Kang et al. | 15/353 |

* cited by examiner

*Primary Examiner*—Dung V Nguyen
(74) *Attorney, Agent, or Firm*—KED & Associates, LLP

(57) ABSTRACT

A vacuum cleaner is provided. The vacuum cleaner includes suction means that provides suction force, a suction nozzle that uses the suction force provided by the suction means to draw in particle laden air, a dust collecting box that receives the particle laden air drawn in through the suction nozzle, an upper cover having an opening at a central portion thereof that provides for selective opening/closing of an upper portion of the dust collecting box, and a filter assembly that is selectively fastened to an edge of the opening, for filtering dust from the particle laden air and discharging the air upward. This structure simplifies cleaning and replacement of the dust collector assembly.

21 Claims, 14 Drawing Sheets

VACUUM CLEANER

CROSS-REFERENCE TO RELATED APPLICATIONS

This application claims the benefit of Korean Application Nos. P2004-16477, P2004-16478, P2004-16481, and P2004-24411, four of which were filed on Mar. 11, 2004, and are hereby incorporated by reference as if fully set forth herein.

BACKGROUND OF THE INVENTION

1. Field of the Invention

The present invention relates to vacuum cleaners, and more particularly, to a vacuum cleaner having an improved dust collector assembly.

2. Description of the Related Art

In general, the vacuum cleaner draws dust-laden air from a floor of a room, removes the dust from the air, and discharges only the air again.

FIG. 1 illustrates a perspective view of a related art vacuum cleaner. As shown, the vacuum cleaner is provided with a body 1, and a suction nozzle 2. The body 1 has a suction means mounted therein for drawing room air. Air is drawn from the floor to the body 1 through the suction nozzle 2 by a suction force generated at the body 1.

The body 1 has a lower body 5 and an upper body 6. The lower body 5 has the suction means mounted therein, and the upper body 6 has electric components mounted therein for controlling the vacuum cleaner. The body 1 has wheels 8 secured to opposite sides of a lower portion thereof, and the wheel 8 has an outlet 8*a* for discharging air having foreign matters removed from the air drawn through the suction nozzle 2.

Between the body 1 and the suction nozzle 2, there are a suction hose 3*b*, an operation part 4, and an extension tube 3*a*. The suction hose 3*b* is formed of a flexible material, and the operation part 4 is at an end of the suction hose 3*b*. The extension tube 3*a* makes the suction hose 3*b* and the suction nozzle 2 in communication.

Upon application of power through a power line 9, the vacuum cleaner is at a standby condition. If a user operates the operation part 4, an appropriate suction force is generated at the suction means in the body 1. The suction force is transmitted to the suction nozzle 2 through the suction hose 3*b*, the operation part 4, and the extension tube 3*a* in succession.

According to this, dust-laden air is drawn through the suction nozzle 2. The dust is separated from the air at a dust collecting box 10, to discharge only the air through the outlet 8*a*. By repeating this process, cleaning of the floor is performed.

However, the related art vacuum cleaner has the following problems.

First, the related art vacuum cleaner has a structure of the dust collecting box difficult to clean, to require much time, or to have inconvenience in cleaning the dust collecting box after finish of the operation.

Second, dismounting of the filter from an inside of the vacuum cleaner is not easy, to cause difficulty in replacement and cleaning of the filter.

SUMMARY OF THE INVENTION

Accordingly, the present invention is directed to a vacuum cleaner that substantially obviates one or more problems due to limitations and disadvantages of the related art.

An object of the present invention is to provide a vacuum cleaner having a dust collector assembly which is easy to replace and clean.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a vacuum cleaner includes suction means for providing suction force, a suction nozzle for drawing room air by the suction force provided from the suction means, a dust collecting box for receiving the room air drawn through the suction nozzle, an upper cover having an opening at a central portion thereof for selective opening/closing of an upper portion of the dust collecting box, and a filter assembly selectively fastened to an edge of the opening, for filtering dust from the drawn air, and discharging the air to upward.

The filter assembly includes an upper holding part loaded on an upper surface of an edge of the opening, the upper holding part having an air discharge hole at a central portion thereof, a lower holding part spaced a distance downward from the upper holding part, and a filter between the upper holding part and the lower holding part, the filter having a discharge passage therein. The edge of the opening includes a step for loading the upper holding part.

The vacuum cleaner further includes a projection piece projected from one side of the upper holding part in a radial direction, and a lever at one side of an upper surface of the upper cover for fastening the projection piece selectively as the lever rotates around a hinge.

The upper cover includes a loading portion at one side recessed downwardly, for accommodating the projection piece and the lever. The upper holding part includes hand grips projected upward from the upper surface thereof.

The upper holding part has a diameter greater than a diameter of the lower holding part. The dust collecting box includes a separation plate for dividing an inside space of the dust collecting box into an upper space and a lower space. The separation plate includes a hole at one side for separating dusts with relatively large masses downward. The separation plate has an outside diameter smaller than an inside diameter of the dust collecting box.

The separation plate is fixed to a top of a supporting member projected upward from a bottom of the dust collecting box. The separation plate includes semicircular first, and second plates, each fastened to the top of the supporting member so as to be rotatable around a hinge shaft. The dust collecting box includes a partition plate between the separation plate and the bottom of the dust collecting box for prevention of circulation of the drawn air.

The vacuum cleaner further includes a filter holding part including a base having a loading recess at a central portion thereof for seating an under side of the lower holding part, and a plurality of extensions each extended from a side of the base in a radial direction to fix the base to an inside surface of the dust collecting box.

The dust collecting box includes a suction guide mounted on an outside surface thereof obliquely for guiding drawn air in a tangential direction. The dust collecting box includes a hand grip on an outside surface thereof. The vacuum cleaner further includes a liquid sprayer provided to an inside of the dust collecting box, having a spray button on a top of the liquid spray connected to a press button provided through the upper cover.

In another aspect of the present invention, a vacuum cleaner includes suction means in a body of the vacuum cleaner for providing suction force, a suction nozzle for drawing room air by the suction force provided from the suction means, a dust collecting box for receiving the room air drawn through the suction nozzle, an upper cover having an opening at a central portion thereof for selective opening/closing of an upper portion of the dust collecting box, a filter assembly selectively fastened to an edge of the opening, for filtering dust from the drawn air, and discharging the air to upward, and a lower cover for opening/closing a bottom of the dust collecting box.

In another aspect of the present invention, a vacuum cleaner includes suction means in a body of the vacuum cleaner for providing suction force, a hand grip on an upper portion of the body, a suction nozzle for drawing room air by the suction force provided from the suction means, a dust collecting box for receiving the room air drawn through the suction nozzle, an upper cover having an opening in an upper surface thereof for selective opening/closing of an upper portion of the dust collecting box, a filter assembly selectively fastened to an edge of the opening, for filtering dust from the drawn air, and discharging the air to upward, a supporting member extended from a bottom of the dust collecting box to upward, the supporting member having a hinge shaft, a separation plate including one pair of semicircular plates provided so as to be rotatable around the hinge shaft for dividing an inside space of the dust collecting box into an upper space and a lower space selectively, and a partition plate between the separation plate and the bottom of the dust collecting box for prevention of circulation of the drawn air.

In further aspect of the present invention, a vacuum cleaner includes suction means in a body of the vacuum cleaner for providing suction force, a hand grip on an upper portion of the body, a suction nozzle for drawing room air by the suction force provided from the suction means, a dust collecting box for receiving the room air drawn through the suction nozzle, an upper cover having an opening at a central portion thereof for selective opening/closing of an upper portion of the dust collecting box, a filter assembly selectively fastened to an edge of the opening, for filtering dust from the drawn air, and discharging the air to upward, a lower cover for selective opening/closing of a bottom of the dust collecting box, a separation plate having a diameter smaller than an inside diameter of the dust collecting box, for dividing an inside space of the dust collecting box into an upper space and a lower space, and a partition plate between the separation plate and the bottom of the dust collecting box for prevention of circulation of the drawn air.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

A vacuum cleaner in accordance with each of the embodiments of the present invention will be described with reference to FIGS. 2~15.

In the vacuum cleaners, there are canister type and upright type of vacuum cleaners. The canister type of vacuum cleaner has a suction nozzle and a body provided separately and connected with a connection tube. Opposite to this, the upright type of vacuum cleaner has the suction nozzle and the body provided as one unit.

The following embodiments are applicable all types of vacuum cleaners including the canister type and the upright type of vacuum cleaners.

Figure 1:
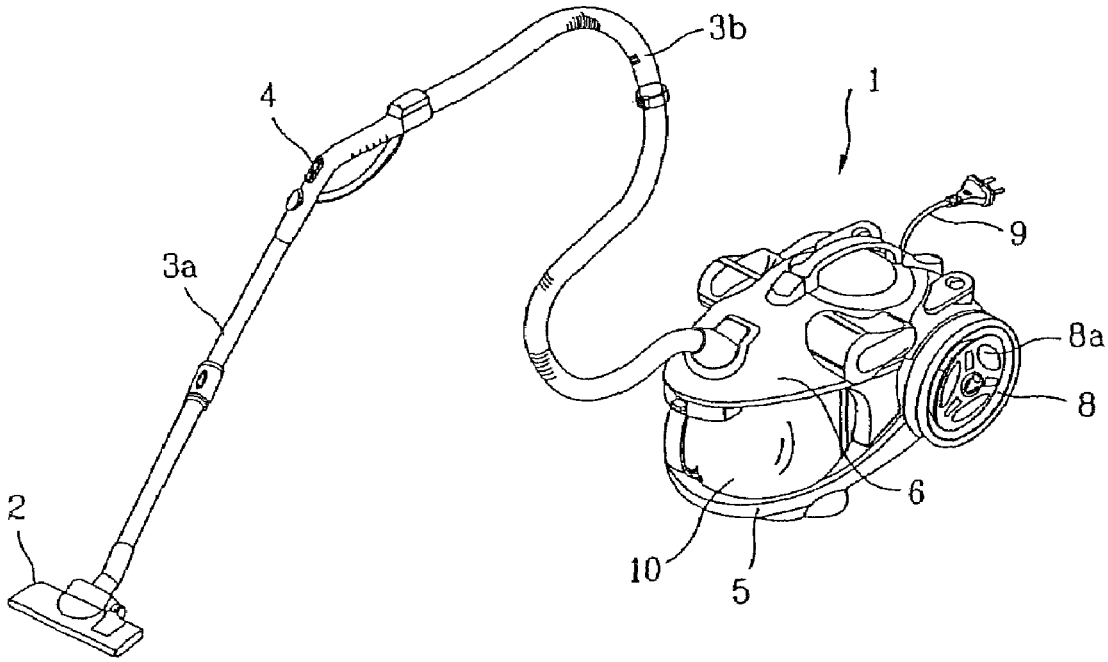
FIG. 1 RELATED ART
FIG. 1 illustrates a perspective view of a related art vacuum cleaner.
Figure 2:
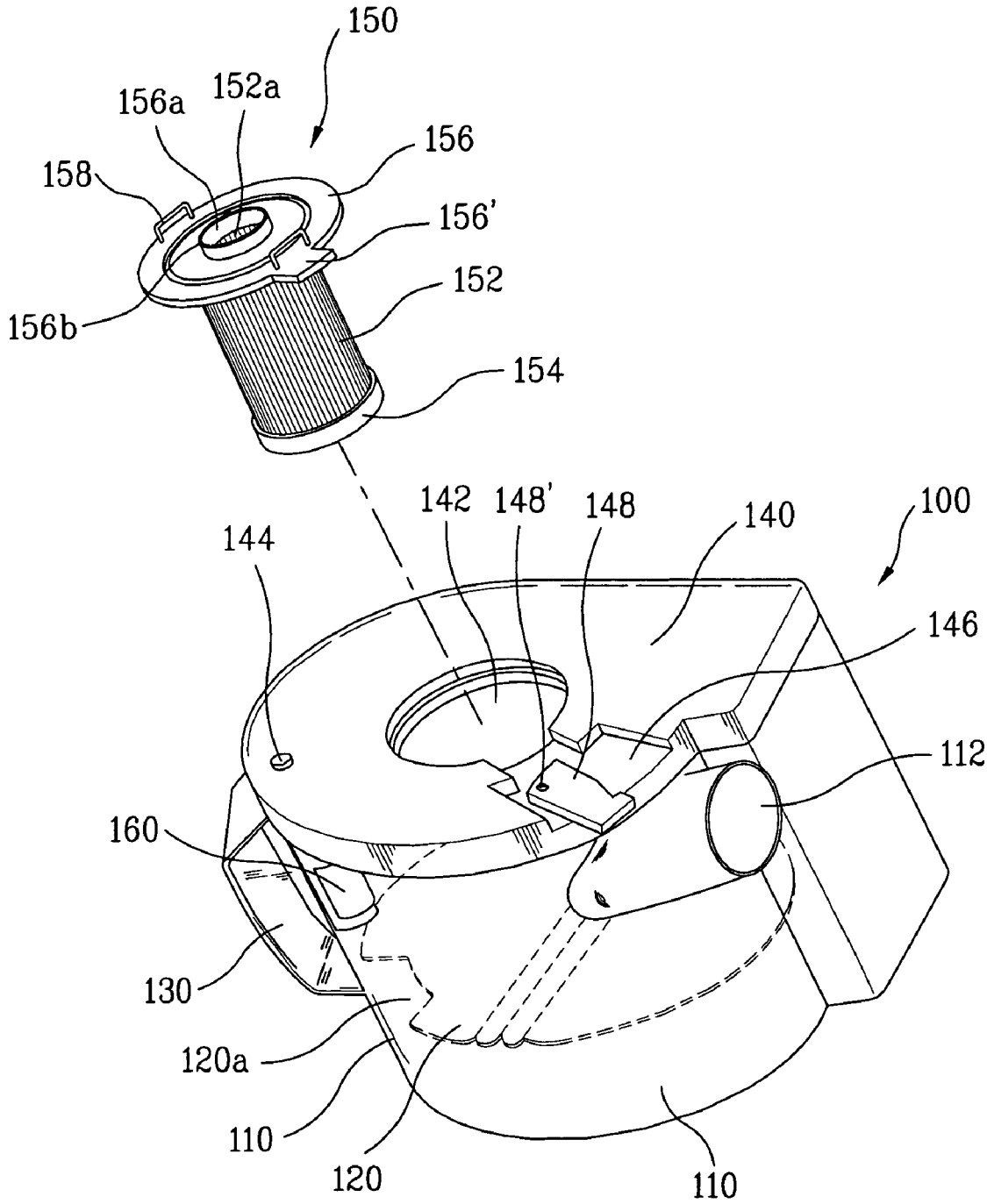
FIG. 2 illustrates a disassembled perspective view of a dust collector assembly in a vacuum cleaner in accordance with a preferred embodiment of the present invention.
Figure 3:
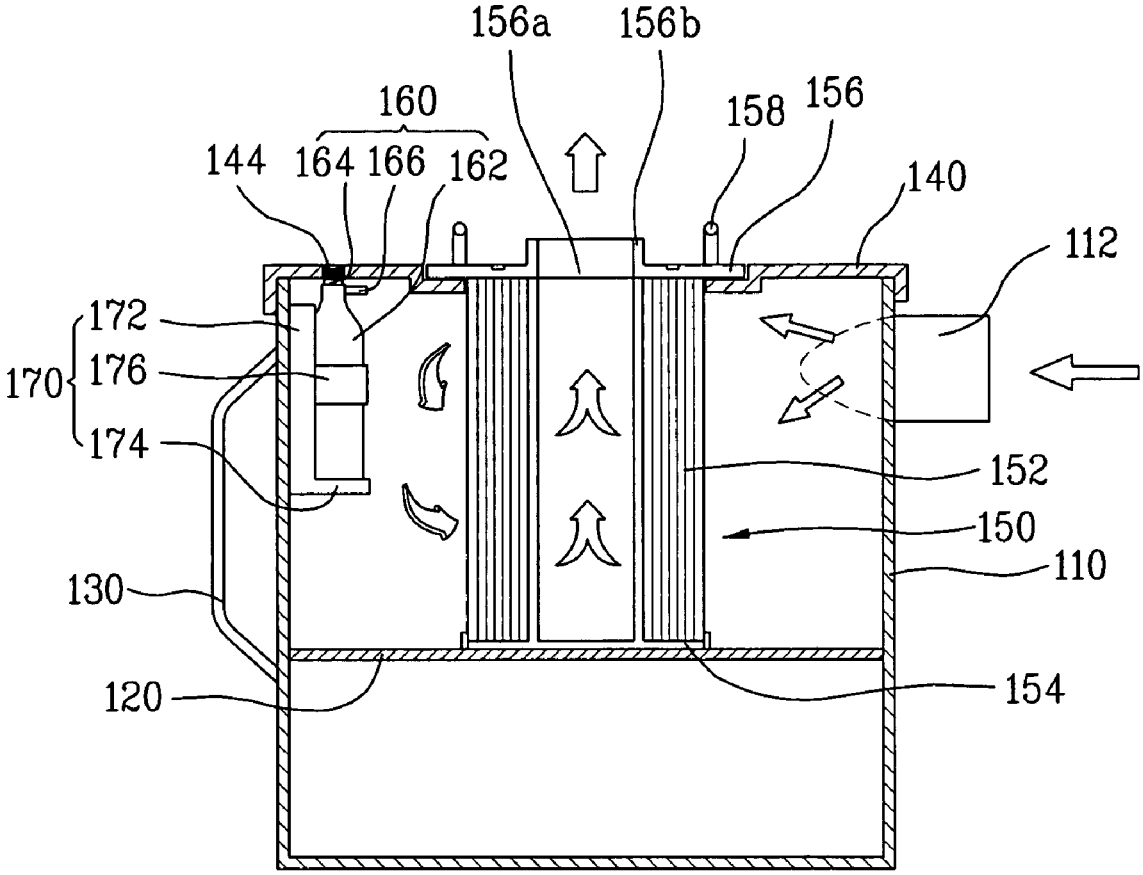
FIG. 3 illustrates a section of a dust collector assembly in accordance with a preferred embodiment of the present invention.
Figure 4:
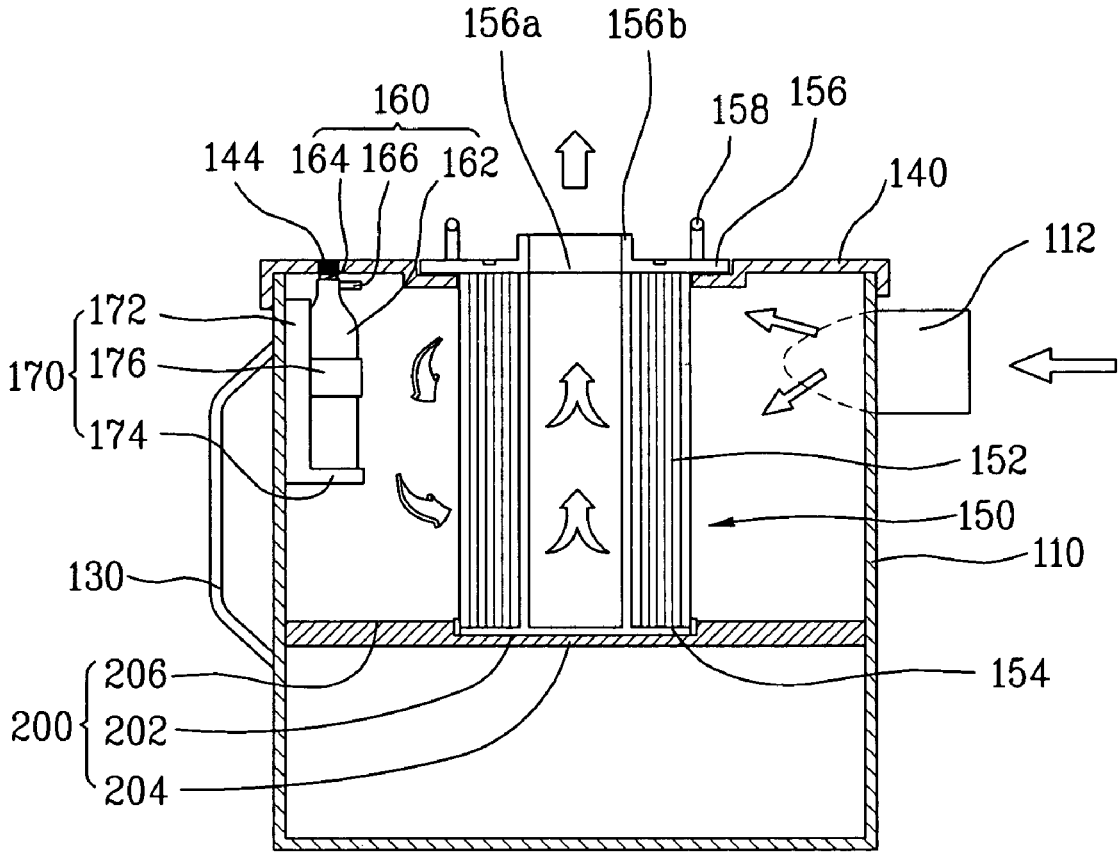
FIG. 4 illustrates a section of a dust collector assembly having a filter holding part mounted thereon in accordance with a preferred embodiment of the present invention.

FIG. 2 illustrates a disassembled perspective view of a dust collector assembly in a vacuum cleaner in accordance with a preferred embodiment of the present invention, and FIGS. 3 and 4 are sections of the dust collector assembly.

Referring to FIG. 2, the dust collector assembly 100 includes a dust collecting box 110, an upper cover 140, and a filter assembly 150.

The body of the vacuum cleaner has suction means mounted therein for providing a suction force, and room air is drawn into the dust collector assembly 100 through the suction nozzle by the suction force.

The dust collecting box 110 is cylindrical substantially, and has a suction guide 112 at a side thereof for guiding the air drawn thereto. The suction guide 112 has one end projected obliquely from an outside surface of the dust collecting box 110, for drawing air through the suction guide 112 in a tangential direction along an inside surface of the dust collecting box 110.

For easy mounting/dismounting to/from the body, the dust collecting box 110 has a hand grip 130 at an outside surface of the dust collecting box 110.

The dust collecting box 110 has an upper cover 140 provided to an upper part thereof for covering the upper part of the dust collecting box 110. The upper cover 140 has an opening 142 at a central portion thereof, for securing the filter assembly 150 therein, selectively.

The filter assembly 150 has an upper holding part 156, a lower holding part 154, and a filter 152. The upper holding part 156 is a circular plate with an air discharge hole 156*a* at a central portion thereof, fitted to an upper surface of an edge of the opening 142. For this, the edge of the opening 142 has a step for fitting to the upper holding part 156.

The lower holding part 154 is spaced a distance from the upper holding part 156 downwardly. The cylindrical filter 152 is provided between the upper holding part 156 and the lower holding part 154. The filter 152 has an air discharge passage 152*a* therein.

The upper holding part 156 has a diameter relatively greater than the lower holding part 154. Accordingly, the lower holding part 154 and the filter 152 can be inserted through the opening 142, more easily.

The air discharge hole 156*a* at a central portion of the upper holding part 156 discharges the air guided through the air discharge passage 152*a*. The air discharge hole 156*a* has a discharge guide 156*b* projected upward from a circumference thereof, so that the discharge hole 156*a* can be connected to the outlet in the body of the vacuum cleaner, easily.

The upper holding part 156 has a hand grip 158 on an upper surface for easy drawing of the filter assembly 150 from the dust collecting box 110. As shown, one pair of hand grips 158 are formed on opposite sides of the discharge hole 156*a*.

In the meantime, the upper cover 140 has a loading portion 146 at one side recessed downwardly. The loading part 146 has fastening means for fastening the filter assembly 150 to the upper cover 140, selectively.

Referring to FIGS. 2 and 3, the fastening means includes a projection piece 156' and a lever 148. The projection piece 156' is projected from one side of the upper holding part 156 in a radial direction. The lever 148 fastens the projection piece 156' selectively as the lever 148 rotates around the hinge 148' mounted on an upper surface of the upper cover 140. Accordingly, as the projection piece 156' is fastened by the lever 148, separation of the filter assembly 150 is prevented.

The operation of the lever 148 will be described in detail.

After rotating the lever 148 to release the projection piece 156', if the hand grip 158 is pulled upward, the filter assembly 150 is separated from the opening 142 of the upper cover 140.

Opposite to this, at the time of securing the filter assembly 150, the filter assembly 150 is inserted in the opening 142, and the lever 148 is rotated, when the projection piece 156' is fastened by the lever 148.

In the meantime, for filtering dust from air, the filter 152 is provided between the holding parts 154, and 156. The filter 152 is formed of an endurable and washable fibrous plastic. It is preferable that the filter 152 is formed of polyester. Moreover, by forming a plurality of folds in a length direction of the filter 152, a contact area with air is increased to improve a dust collecting capability.

A mesh filter may further be provided to an outside of the filter 152, or a plurality of filters may be provided in multiple layers.

The discharge passage 152*a* is inside of the filter 152, such that the air passed through the filter 152 flows upward along the discharge passage 152*a* until the air is discharged through the discharge hole 156*a*.

For maintaining the cylindrical filter 152 between the holding parts 154 and 156, it is preferable that means for connecting the upper and lower holding parts 154, and 156, and supporting the filter 152 is required. The supporting means may be a plurality of ribs connected between the holding parts or a cylindrical member having a plurality of holes.

For dividing an inside space of the dust collecting box 110 in an upper and a lower spaces, a separation plate 120 is provided to an inside of the dust collecting box 110, and a hole 120*a* is formed in one side of the separation plate 120. Dust particles with relatively large masses in the air drop down below the separation plate 120 through the hole 120*a*.

The lower holding part 154 is in contact with an upper surface of the separation plate 120. Therefore, since the lower holding part 154 is supported on the separation plate 120, the lower holding part 154 is held, more securely.

Figure 5:
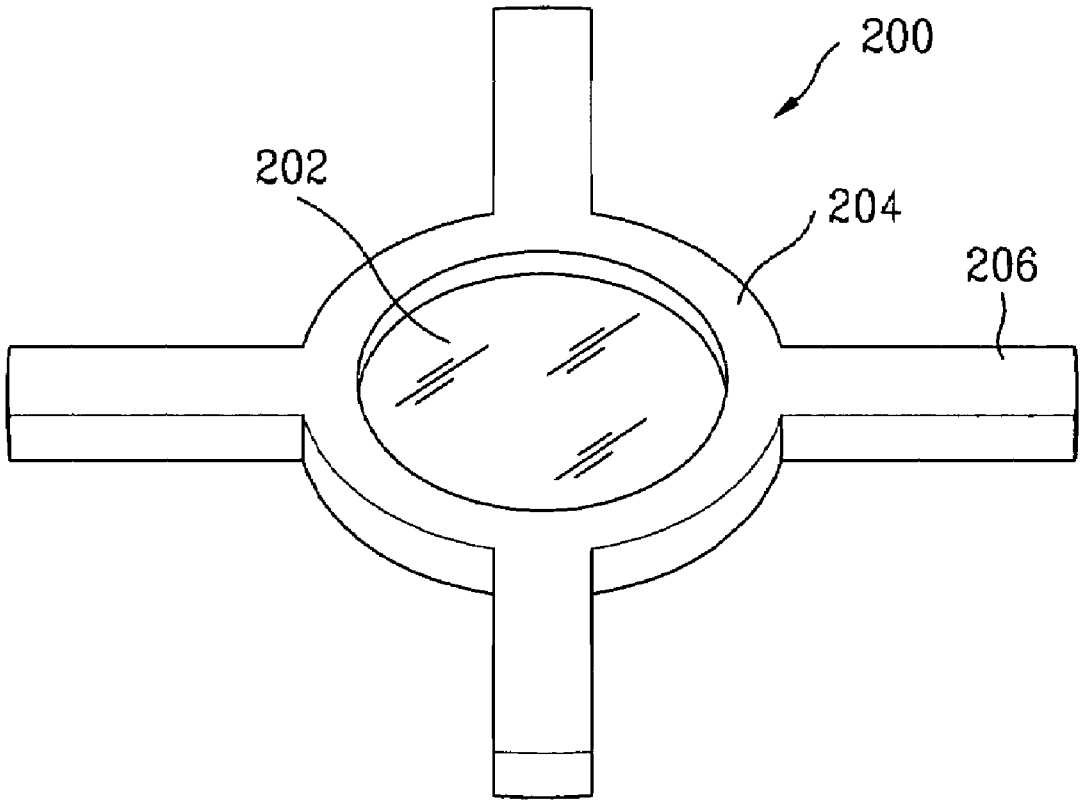
FIG. 5 illustrates a perspective view of a filter holding part in accordance with a preferred embodiment of the present invention.

FIG. 4 or 5 illustrate a diagram of a filter holding part applied to the present invention.

Referring to FIGS. 4 and 5, the filter holding part provided under the filter assembly includes a base and a plurality of extensions.

The base has a loading recess for seating an underside of the lower holding part. The extensions, extended in a radial direction from a side of the base, are fixed to an inside surface of the dust collecting box.

In the meantime, referring to FIGS. 2~4, the dust collecting box 110 has a liquid sprayer 160 at one side of an inside thereof. The liquid sprayer 160 includes a body 162, a spray button 164, and a spray nozzle 166.

Liquid is stored in the cylindrical body 162. The spray nozzle 166 is on an upper portion of the body 162, and a spray button 164 is provided to a top of the body 162. Upon pushing the spray button 164, the liquid is sprayed through the spray nozzle 166. The sprayed liquid increases humidity of an inside of the dust collecting box, to prevent static electricity. The liquid has insecticide, germicide, aromatic agent, or the like added thereto.

The upper cover 140 of the dust collecting box has a press button 144 in the vicinity of an edge thereof in contact with the spray button 164. Therefore, upon pressing the press button 144, the spray button is pressed simultaneously, and the liquid is sprayed through the spray nozzle 166.

The liquid sprayer 160 is mounted on a mounting part 170 on an inside of the dust collecting box 110. The mounting part 170 includes an attachment portion 172, a supporting plate 174, and elastic arms 176.

The attachment portion 172 is attached to the inside surface of the dust collecting box 110, and the supporting plate 174 is on an underside of the attachment portion 172 for supporting an underside of the liquid sprayer 160. The elastic arms 176 are respectively extended forward from opposite sides of a substantially middle portion of the attachment part 172, and have elasticity. The elastic arms 176 are curved to surround the body 162, for receiving and holding the body 162 by an elastic deformation.

That is, upon pushing in the liquid sprayer 160, the elastic arms 176 move away from each other, to receive and hold the liquid sprayer 160 on an inside thereof.

The operation of the dust collector assembly in the vacuum cleaner in accordance with a preferred embodiment of the present invention will be described.

The dust-laden air drawn through the suction nozzle is introduced into an inside of the dust collecting box 110 through the suction guide 112.

In this instance, dust particles with relatively large masses drop down below the separation plate 120, and dust particles with relatively small masses are separated by the filter during the dust particles flow together with air, and accumulated on an inside of the dust collecting box 110. The air passed through the filter 152 is discharged through the discharge hole 156*a* via the discharge passage 152*a*.

In this instance, upon pressing the press button 144 on the upper cover 140 of the dust collecting box, the spray button 164 on the liquid sprayer 160 is pressed, to spray the liquid toward an inner portion of the dust collecting box 110 through the spray nozzle 166.

Figure 6:
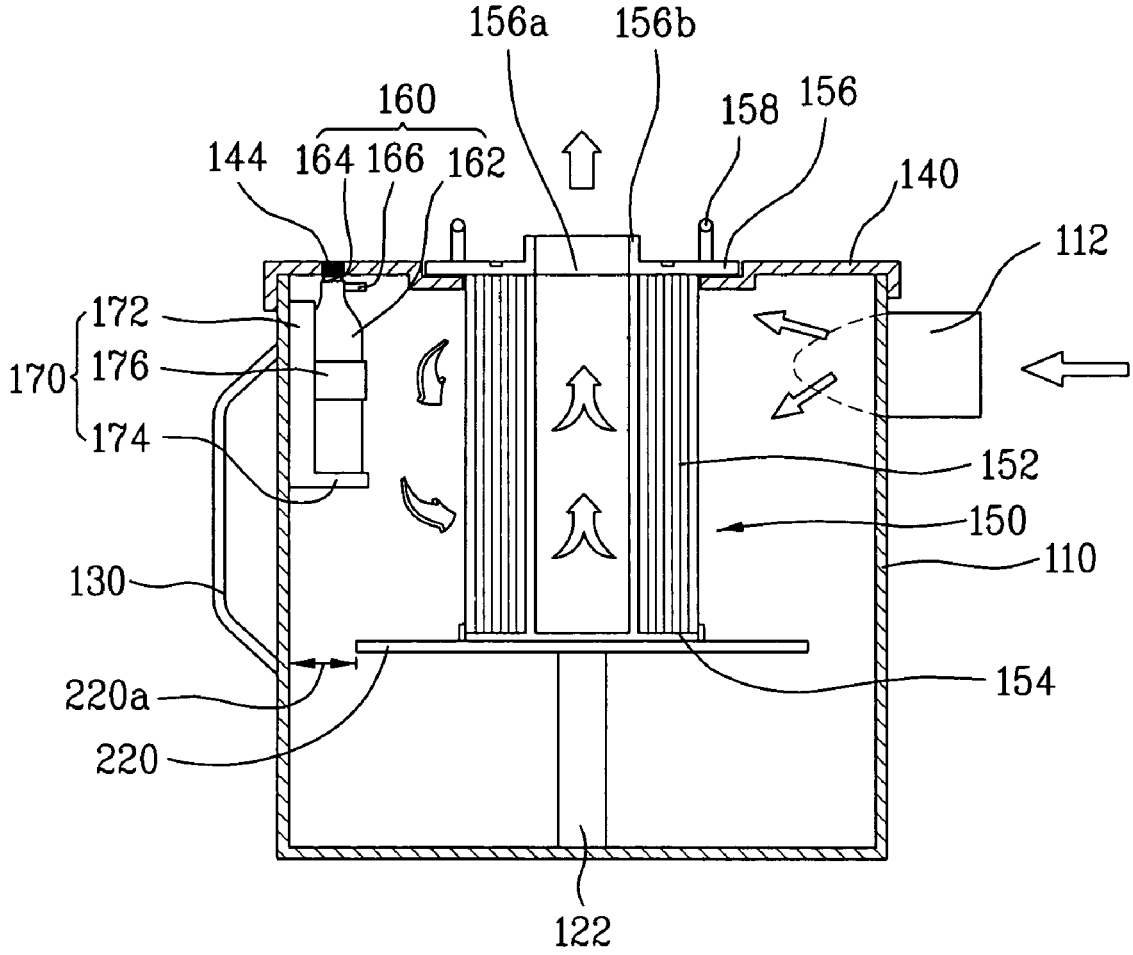
FIG. 6 illustrates a section of a dust collector assembly in a vacuum cleaner in accordance with other preferred embodiment of the present invention.
Figure 7:
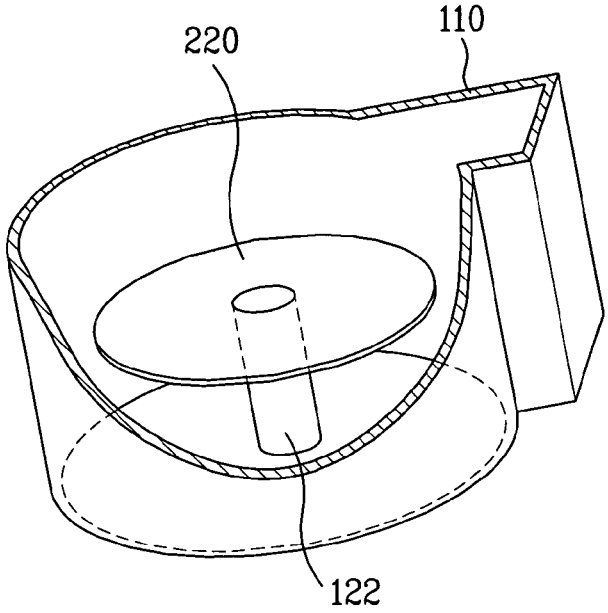
FIG. 7 or 8 illustrates a perspective view of a separation plate in accordance with other preferred embodiment of the present invention.
Figure 8:
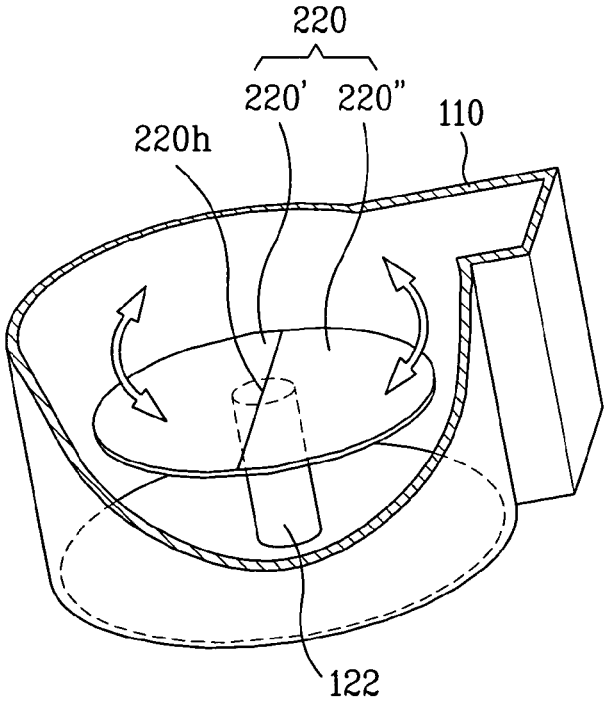

FIGS. 6~8 illustrate a dust collector assembly in accordance with other preferred embodiment of the present invention.

Referring to FIGS. 6 and 7, an upper portion of the dust collecting box 110 is opened, and the upper portion is opened/closed with an upper cover 140. The upper cover 140 has an opening in a central portion thereof, for selective securing of the filter assembly 150.

There is a separation plate 220 fixed to an upper portion of a lower portion of the dust collecting box for dividing an inside space of the dust collecting box 110 into an upper space, and a lower space. That is, there is a supporting member 122 projected upward from a bottom of the dust collecting box 110, and the separation plate 220 is provided to a top of the supporting member 122. It is preferable that the separation plate 220 and the bottom of the dust collecting box 110 are formed as one unit.

The separation plate 220 has an outside diameter smaller than an inside diameter of the dust collecting box 110, to form a gap 220*a* between the separation plate 220 and an inside surface of the dust collecting box 110. Dust particles with comparatively large masses drop down below the separation plate 220 through the gap 220*a*.

In the meantime, referring to FIG. 8, the separation plate 220 includes a first plate 220' and a second plate 220", and the supporting member 122 has a hinge shaft 220*h* at a top thereof. The first plate 220' and the second plate 220" are semicircular, and rotatable around the high shaft 220*h*.

If the plates 220' and 220" are rotated upward, most of the upper and lower spaces of the separation plate 220 are in communication with each other. Once the plates 220' and 220" are rotated upward, the user can clean the dust under the separation plate 220, easily.

Figure 9:
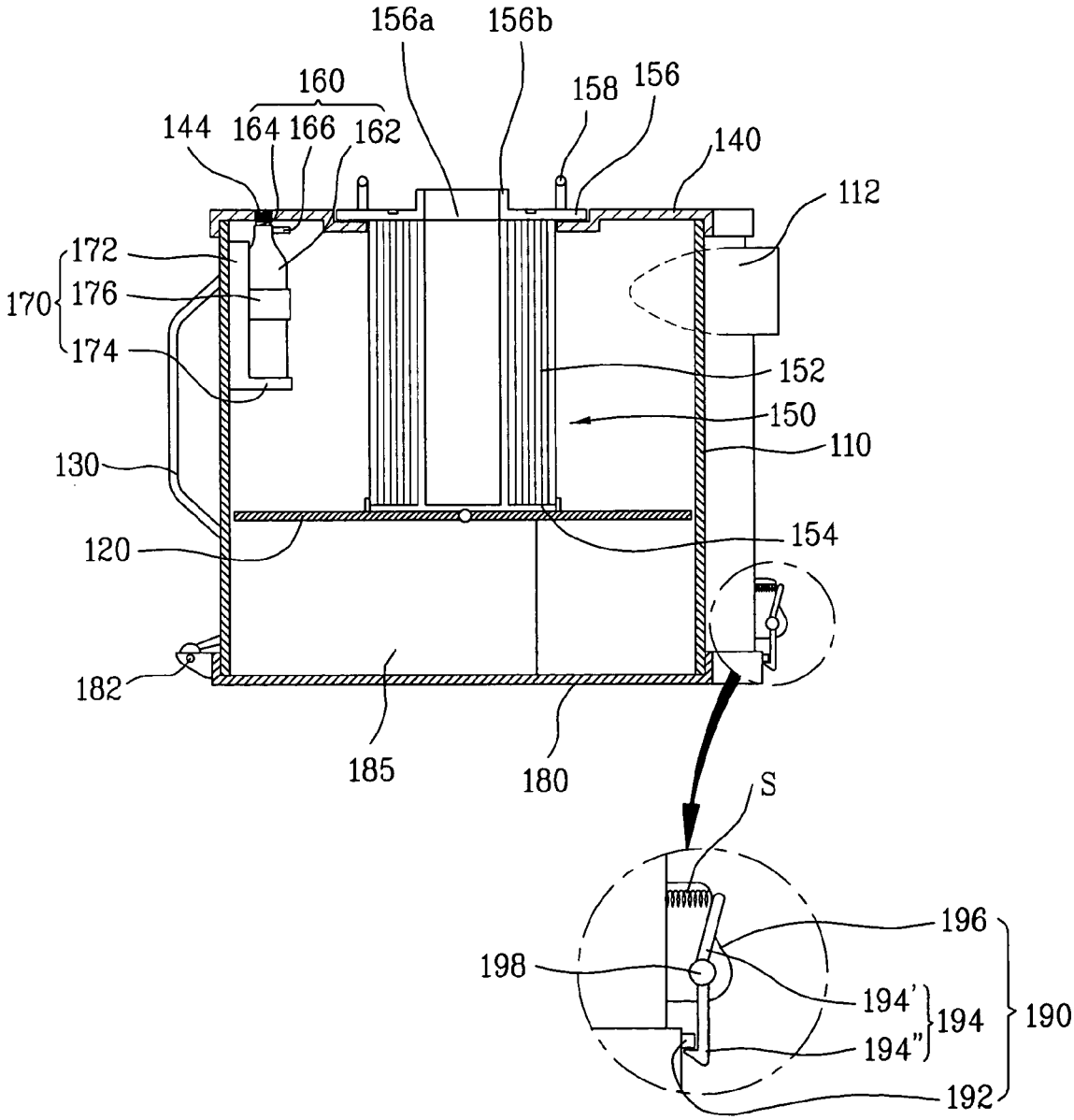
FIG. 9 or 10 illustrates a section of a dust collector assembly in a vacuum cleaner in accordance with other preferred embodiment of the present invention.
Figure 10:
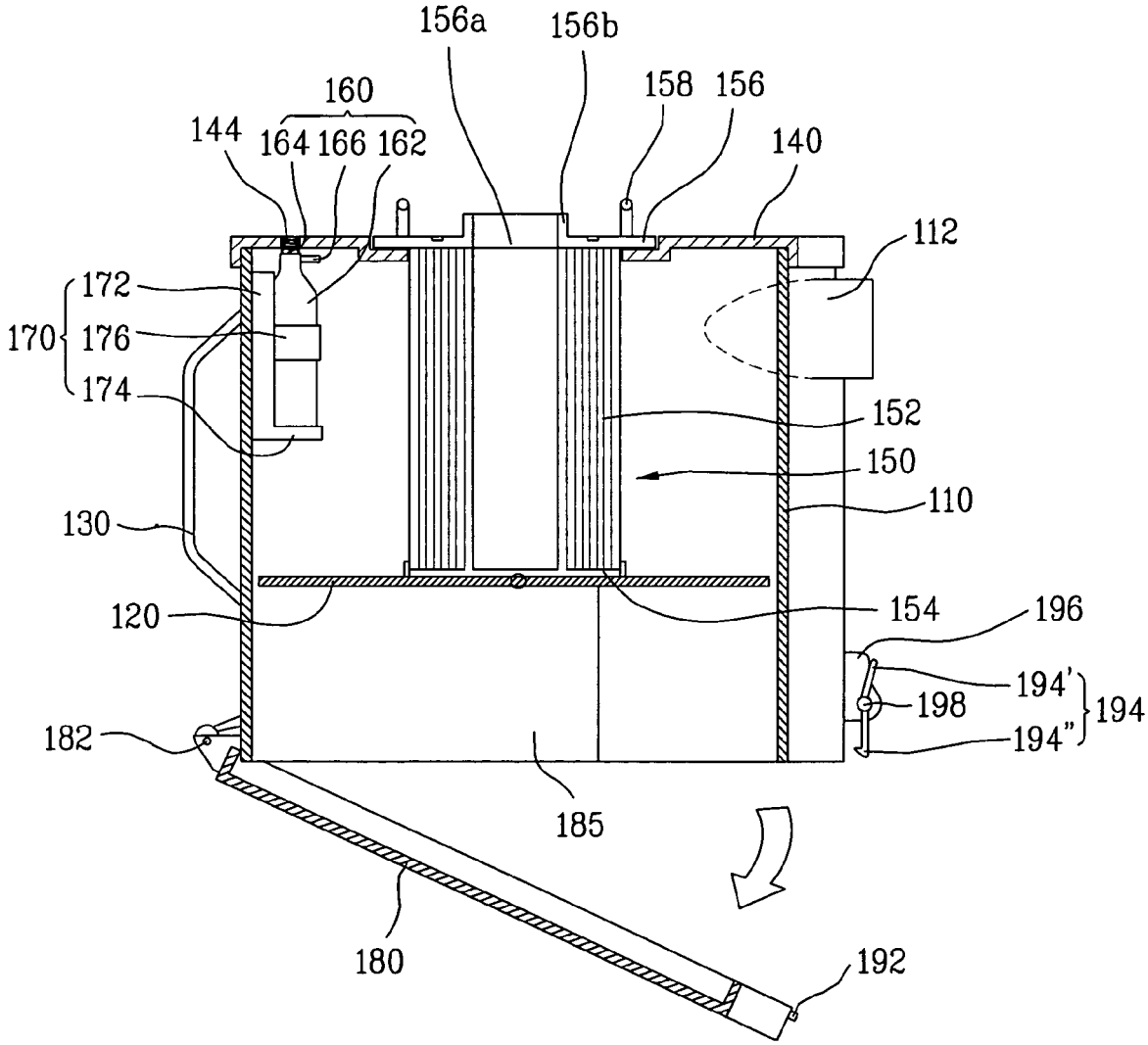

FIG. 9 or 10 illustrates a diagram of a dust collector assembly in accordance with another preferred embodiment of the present invention.

Referring to FIG. 9, the dust collecting box 110 has opened upper, and lower portions, and the opened lower portion is opened/closed with a lower cover 180, selectively. The lower cover 180 rotates around a cover hinge 182 provided to a lower portion of the dust collecting box 110. There is a locking assembly 190 opposite to cover hinge 182 for selective fastening of the lower cover 180.

The locking assembly 190 includes a projection 192, a hinge shaft 198, a rotatable hook 194, and a spring 'S'. The projection 192 is projected from the lower cover 180, and the hinge shaft 198 is projected from a holding part 196 provided to an outside surface of the dust collecting box 110. The rotatable hook 194 makes seesaw movement around the hinge shaft 198.

The rotatable hook 194 includes a hook portion 194" for hooking the projection 192 selectively, and a button portion 194'. The spring 'S' is between the button portion 194' and the outside surface of the dust collecting box 110. When the button portion 194' is pressed, the hook portion 194" rotates in a counter clockwise direction, and the projection 192 is released from an engaged state. Opposite to this, if no force is applied to the button portion 194', the button portion 194' rotates in a clockwise direction by the spring 'S'.

In the meantime, the projection may be formed on the outside surface of the dust collecting box 110, while the rotatable hook 192 is formed on the lower cover 180.

In the meantime, a partition wall 185 is provided between the lower cover 180 and the separation plate 120, for prevention of circulation of air. The partition wall 185, not only supports the separation plate 120, but also prevents the air introduced to side below the separation plate 120 from circulating, to prevent the dust from flying.

FIG. 10 illustrates a section showing an opened state of the lower cover.

Referring to FIG. 10, upon pressing a button portion 194' of the locking assembly, the projection 192 is disengaged from the hook portion 194. Then, the lower cover 180 rotates around the cover hinge 182. Therefore, the user can clean an inside of the dust collecting box 110 after opening, not only the upper portion, but also the lower portion.

Opposite to this, when it is intended to close the lower portion of the dust collecting box 110, what is required is pressing the lower cover 180 stronger than compression force of the spring 'S'. For this, one side of the hook portion 194" to be brought into contact with the projection 192 is sloped, for the projection 192 to slide along the sloped surface until the projection 192 is hooked at the hook portion 194".

FIGS. 11~15 illustrate sections each showing a dust collector assembly in a vacuum cleaner in accordance with another preferred embodiment of the present invention.

Figure 11:
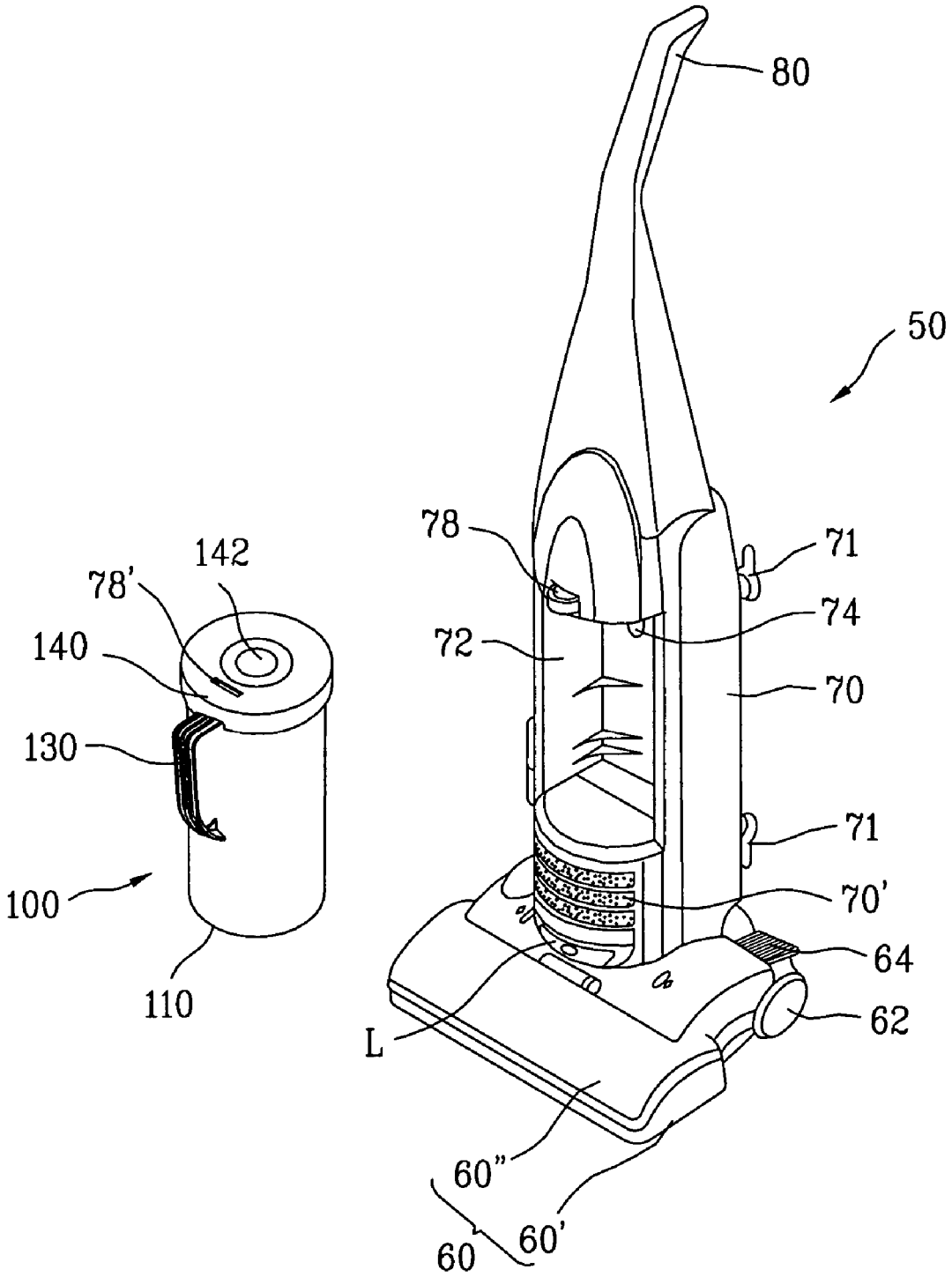
FIG. 11 illustrates a perspective view of a vacuum cleaner in accordance with another preferred embodiment of the present invention.

FIG. 11 illustrates a diagram showing a dust collector assembly of the present invention mounted on an upright type vacuum cleaner.

Referring to FIG. 11, the vacuum cleaner 50 includes a suction nozzle 60, a body 70, and a dust collector assembly 100.

The body 70 is on the suction nozzle 60, and has suction means therein for generating suction force. There is a hand grip 80 for the user to hold the upright type vacuum cleaner.

The suction nozzle 60 includes an upper nozzle cover 60", and a lower nozzle cover 60'. The lower nozzle cover 60' has a suction passage in an underside surface thereof for drawing dust-laden air from a floor of the room, and there are wheels 62 to a rear of the suction nozzle 60.

The body 70 is rotatably mounted on the suction nozzle 60, and there is a rotating lever 64 in rear of the suction nozzle 60 for controlling the rotation. The body 70 may be slanted by stepping on the rotating lever and pulling the body 70 backward.

The body 70 has a wire holder 71 on a rear surface thereof, and a cavity portion 72 in a front thereof for receiving the dust collector assembly 100.

Figure 12:
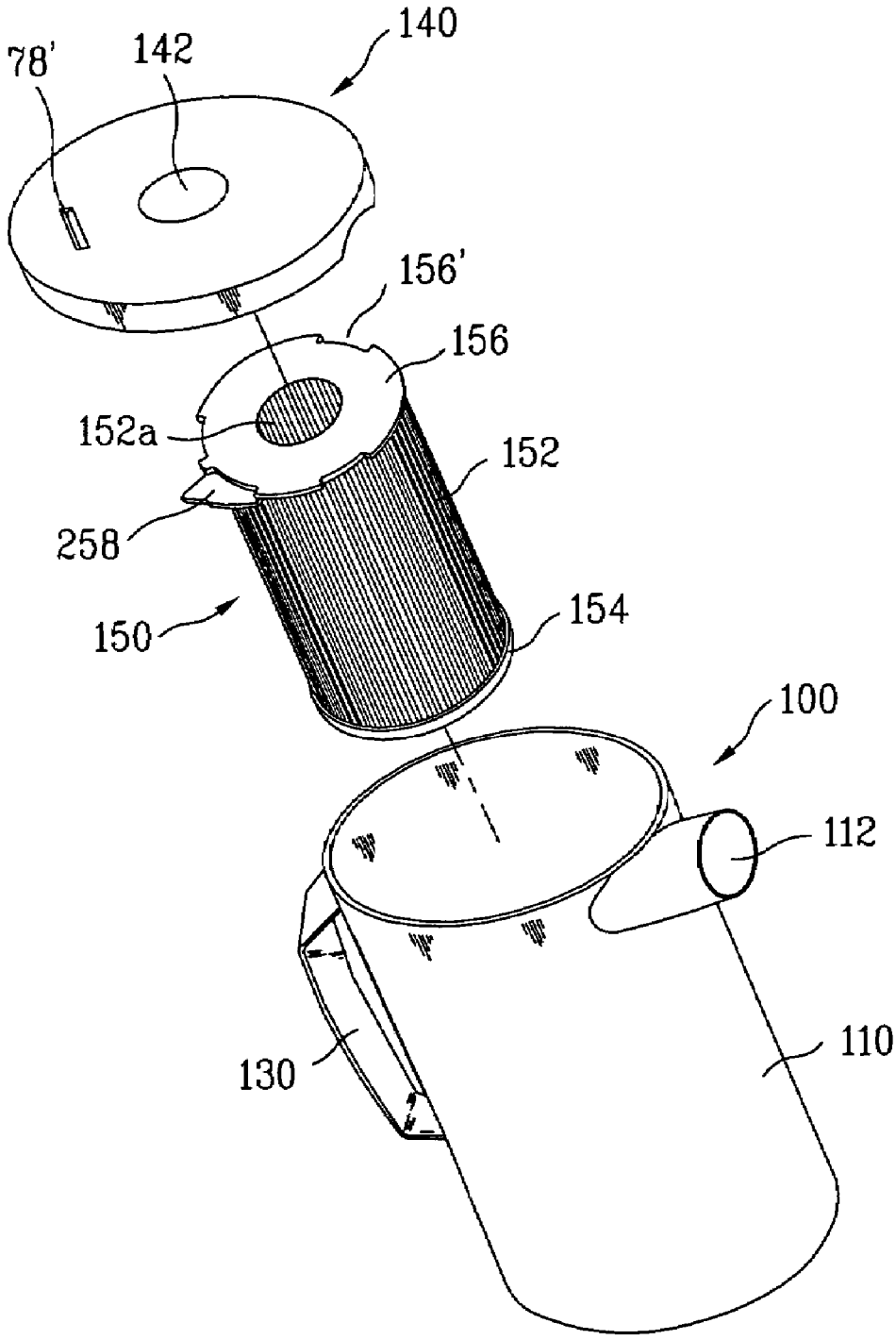
FIG. 12 illustrates a disassembled perspective view of a dust collector assembly in a vacuum cleaner in accordance with another preferred embodiment of the present invention.

FIG. 12 illustrates a disassembled perspective view of a dust collector assembly in a vacuum cleaner in accordance with another preferred embodiment of the present invention.

Referring to FIG. 12, the dust collector assembly 100 includes a dust collecting box 110, an upper cover 140, and a filter assembly 150. There is a hand grip 130 on an outside surface of the dust collecting box 110, and the upper cover 140 has an opening 142 at a central portion thereof.

Referring to FIGS. 11 and 12, the dust collector assembly 100 has an inlet 112 formed in line with a suction passage in the cavity portion 72. There is a knob 78 over the cavity portion 72, and as one end of the knob 78 is inserted into a knob slot 78', the dust collecting assembly 100 is fastened to the cavity portion 72.

Figure 13:
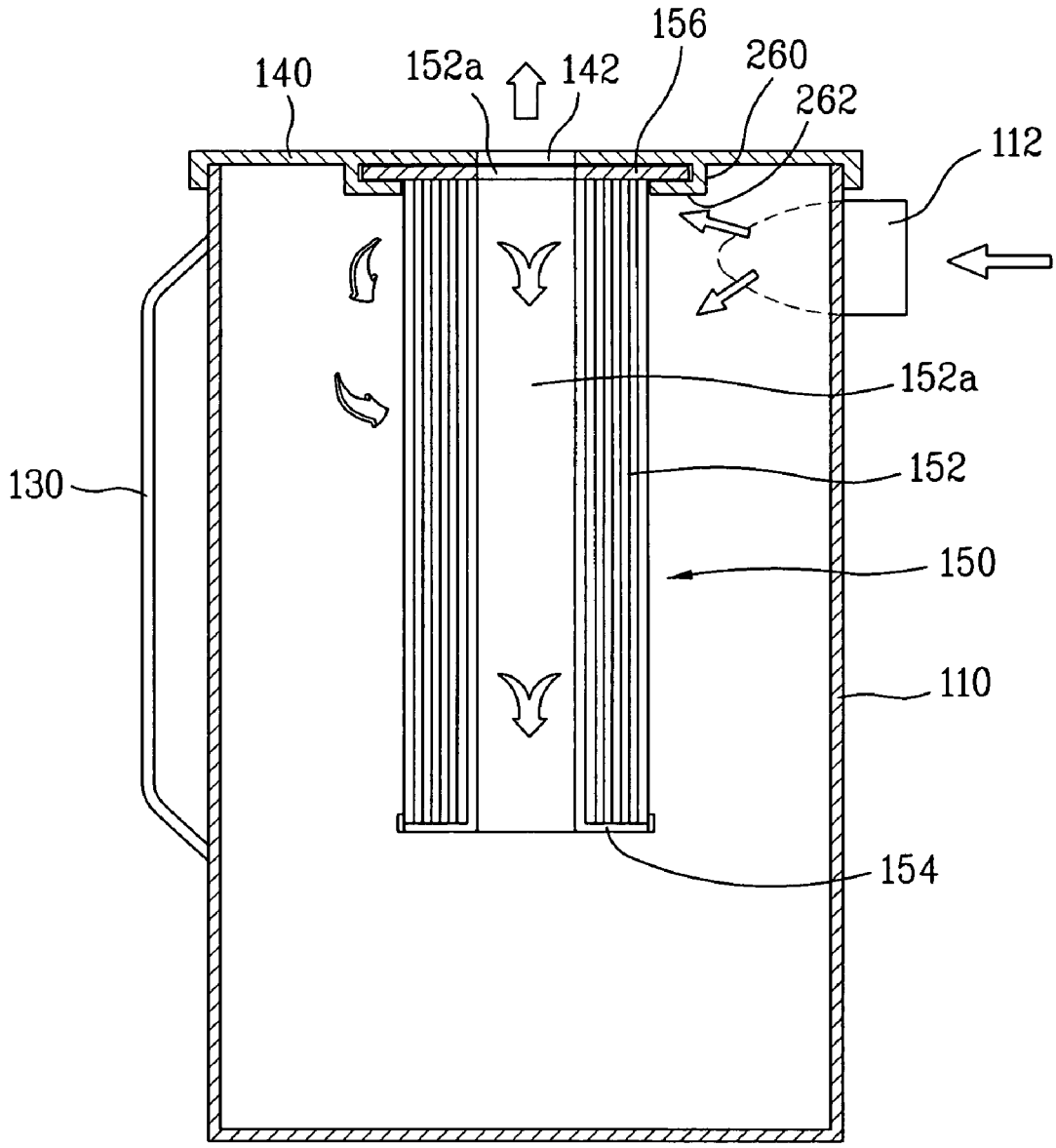
FIG. 13 illustrates a section of a dust collector assembly in accordance with another preferred embodiment of the present invention.
Figure 14:
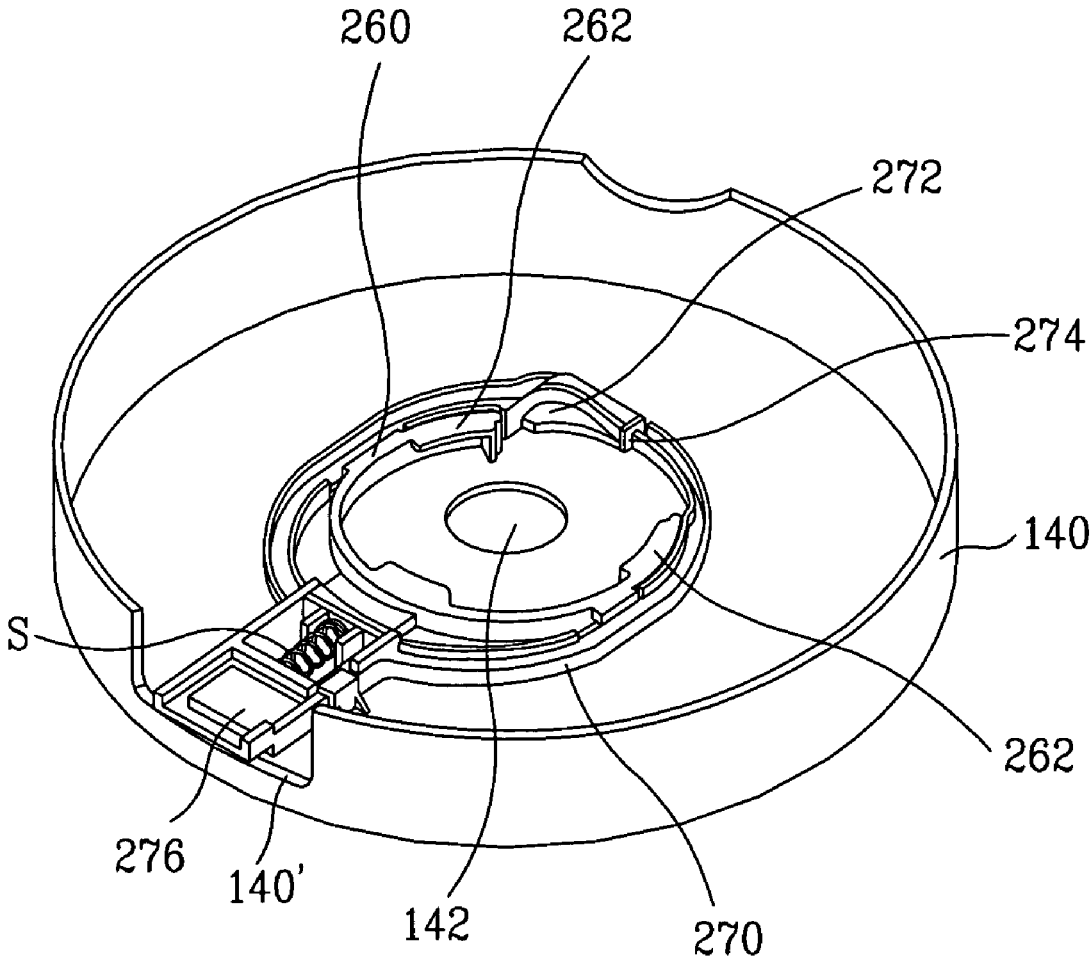
FIG. 14 illustrates a perspective view of an upper cover of a duct collector assembly in accordance with another preferred embodiment of the present invention.

FIG. 13 illustrates a section of a filter assembly fixed to an under side of the upper over, and FIG. 14 illustrates a perspective underside view of the upper cover.

Referring to FIGS. 12~14, the filter assembly 150 is fixed to an under side of the upper cover 140, selectively. The filter assembly includes an upper holding part 156, a lower holding part 154, and a filter 152.

The upper holding part 156 has an air discharge hole 152*a* at a central portion thereof, and recesses 156' at regular intervals in a circumferential direction. There is a lip 258 under one of the recesses 156'.

In the meantime, the upper cover 140 has a filter mounting assembly on an underside of an inner edge of the opening 142.

Referring to FIG. 14, the filter mounting assembly includes a mounting portion 260, a moving member 270, align means 276, and a spring 'S'.

The mounting portion 260 is circular along an inner edge of the opening 142, and extended downwardly. There are holding pieces 262 each projected in a radial direction inwardly from each end of the extensions. It is preferable that the mounting portion 260 is formed as one unit with the upper cover 140.

Upon inserting the holding pieces 262 between the recesses in the upper holding part 156, and rotating the filter assembly 150, the holding pieces 262 engage with an outside circumferential surface of the upper holding part 156. According to this, the filter assembly 150 is fastened to the underside of the upper cover 140.

In the meantime, the moving member 270 is provided to an outside of the mounting portion 260, and is brought into contact with the lip 258, selectively. The mounting portion has one opened side through which the lip 258 is brought into contact with the moving member 270.

The align means 276 is projected from a side of the moving member 270 to an outside of the upper cover 140. The upper cover 140 has a U-cut 140' in one side surface thereof for pass of the align means 276, and there is a spring 'S' between the align means 276 and an outside circumferential surface of the mounting portion 260.

Referring to FIGS. 12 and 14, the moving member 270 has an operation recess 272 for receiving the lip 258 therein. The operation recess 272 has a stopper 274 at one side thereof for stopping rotation of the lip 258. When the upper holding part 156 of the filter assembly 150 is inserted in, and fastened to the mounting portion 260, the lip 258 is inserted in the operation recess 272. In this instance, the align means 276 is projected outward by a restoring force of the spring 'S'.

Then, as the filter assembly 150 rotates in a clockwise direction, the lip 258 moves to a right side of the stopper 274 until the lip 258 is brought into contact with the moving member 270, when the lip 258 pushes the moving member 270 backward.

The align means 276 is provided to a part opposite to a part the moving member 270 and the lip 258 are brought into contact. Therefore, if the moving member 270 is pushed backward, the align means moves back to an inside of the U-cut 140'. The moving back of the align means 276 indicates that the filter assembly 150 is fastened to the upper cover, accurately.

Opposite to this, when it is intended to separate the filter assembly 150 from the upper cover 140, in a state the moved back align means is pushed backward further, the filter assembly 150 is rotated in a counter clockwise direction.

In this instance, the lip 258 moves toward the operation recess 272, and the align means 276 is projected to the outside of the upper cover 140, again. Also, the holding pieces 262 disengage through the recesses 156'.

As described before, the user can determine if the filter assembly 150 is fastened accurately depending on an extent of projection of the align means 276. If the filter assembly 150 is not fastened to the cover 140 accurately, the align means 276 interferes with a top of the dust collecting box 110, to fail the accurate fastening of the upper cover 140 with the top of the dust collecting box 110.

In the meantime, after the upper cover is mounted on the dust collecting box, as one end of the knob 78 is inserted in the slot 78', the dust collector assembly 150 is fastened to the cavity portion 72 of the vacuum cleaner.

Figure 15:
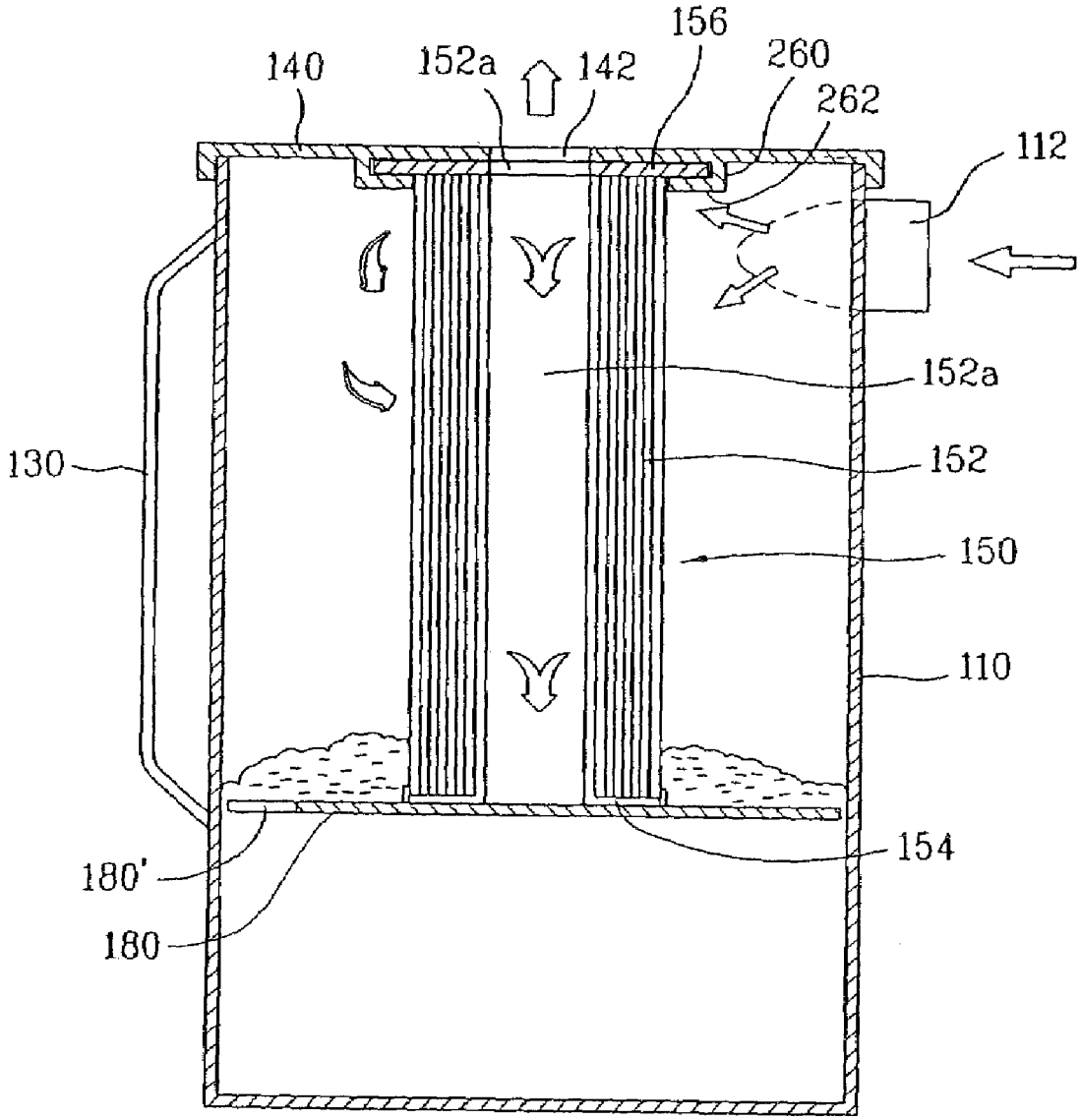
FIG. 15 RELATED ART
FIG. 15 illustrates a section showing a separation plate mounted on the dust collector assembly.

FIG. 15 illustrates a section showing a separation plate mounted on the dust collector assembly, for dividing an inside of the dust collecting box into an upper portion and a lower portion.

Referring to FIG. 15, the separation plate 180 is in contact with an under side of the filter assembly 150, and the separation plate 180 has a hole 180' in one side thereof for falling down of dust particles with comparatively large masses.

As has been described, the dust collector assembly in a vacuum cleaner of the present invention has the following advantages.

First, the detachable provision of the filter assembly to an upper surface of the dust collecting box permits separation of only the filter assembly in an upper direction as required. Therefore, the user can clean the dust collector assembly more easily, and replacement of the filter assembly is easy.

Second, by pressing a press button, to spray liquid from a liquid sprayer as required, humidity of the vicinity of the filter assembly can be increased, and generation of static electricity at an inside of the duct collecting container can be prevented.

Third, the upper surface of the dust collecting box can be opened/closed with the upper cover, selectively. Dust can be cleaned from an inside of the dust collecting box easily after the upper cover is opened.

Fourth, as the air discharge hole of the dust collecting box is formed in an upper portion thereof, so that the dust drops down by gravity, and the cleaned air is discharged upward, more effective cleaning can be made.

Fifth, in a case the filter assembly is not fastened to the upper cover, the dust collector assembly is not received at the cavity portion of the vacuum cleaner. Therefore, defective assembly of the filter assembly can be prevented in advance.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A vacuum cleaner, comprising:

a suction device that provides suction force;

a suction nozzle that draws in particle laden air using the suction force provided by the suction device;

a dust collecting box that receives the particle laden air drawn in by the suction nozzle;

an upper cover having an opening at a central portion thereof, when the upper cover selectively opens and closes an upper portion of the dust collecting box; and a filter assembly that is removably fastened to an edge of the opening in the upper cover, wherein the filter assembly comprises a projection piece that extends outward from an upper portion thereof, and the upper cover includes a lever that selectively engages and disengages the projection piece so as to couple and decouple the filter assembly and the upper cover, and wherein the filter assembly is configured to be inserted into the dust collecting box from a space above the upper cover through the opening in the upper cover, and to be withdrawn from the dust collecting box into the space above the upper cover through the opening in the upper cover.

2. The vacuum cleaner as claimed in claim 1, wherein the filter assembly includes:

an upper holding part removably coupled to an upper surface of an edge of the opening in the upper cover, wherein the upper holding part has an air discharge hole provided at a central portion thereof;

a lower holding part provided at a predetermined distance downward from the upper holding part; and a filter positioned between the upper holding part and the lower holding part, the filter having a discharge passage formed therein.

3. The vacuum cleaner as claimed in claim 2, wherein the edge of the opening includes a step on which the upper holding part is positioned.

4. The vacuum cleaner as claimed in claim 2, wherein the projection piece projects outward in a radial direction from an outer peripheral portion of the upper holding part, and the lever is provided at an upper surface of the upper cover so as to selectively engage the lever as the lever rotates around a hinge.

5. The vacuum cleaner as claimed in claim 4, wherein the upper cover includes a loading portion formed as a recess in the upper surface of the upper cover so as to receive the projection piece and the lever.

6. The vacuum cleaner as claimed in claim 2, wherein the upper holding part includes at least one grip that projects upward from an upper surface thereof.

7. The vacuum cleaner as claimed in claim 2, wherein a diameter of the upper holding part is greater than a diameter of the lower holding part.

8. The vacuum cleaner as claimed in claim 2, further comprising a filter holding part, including:

a base having a loading recess formed at a central portion thereof, wherein the loading recess receives a lower portion of the lower holding part; and a plurality of extensions that each extend outward in a radial direction from an outer peripheral edge of the base so as to fix the base to an inside surface of the dust collecting box.

9. The vacuum cleaner as claimed in claim 1, wherein the dust collecting box includes a separation plate that divides an interior space of the dust collecting box into an upper space and a lower space.

10. The vacuum cleaner as claimed in claim 9, wherein the separation plate includes a hole formed at a peripheral edge portion thereof that directs particles of relatively large size downward into the lower space.

11. The vacuum cleaner as claimed in claim 9, wherein an outside diameter of the separation plate is less than an inside diameter of the dust collecting box.

12. The vacuum cleaner as claimed in claim 11, wherein the separation plate is fixed to a top of a supporting member that projects upward from a bottom of the dust collecting box.

13. The vacuum cleaner as claimed in claim 11, wherein the separation plate includes semicircular first and second plates, each fastened to the top of the supporting member so as to rotate about a hinge shaft aligned along mating edges of the semicircular first and second plates.

14. The vacuum cleaner as claimed in claim 9, wherein the dust collecting box includes a partition plate positioned in a lower space formed between the separation plate and a bottom of the dust collecting box, wherein the partition plate is positioned in the lower space at an angle with respect to the separation plate and the bottom of the dust collection box so as to prevent circulation of air within the lower space.

15. The vacuum cleaner as claimed in claim 14, wherein the partition plate extends substantially vertically upward from an inner surface of the bottom of the dust collecting box to a bottom surface of the separation plate, and at least halfway across the space formed between the separation plate and the bottom of the dust collecting box.

16. The vacuum cleaner as claimed in claim 1, wherein the dust collecting box includes a suction guide mounted in an oblique direction on an outside surface thereof so as to direct particle laden air into the dust collecting box in a tangential direction.

17. The vacuum cleaner as claimed in claim 1, wherein the dust collecting box includes a handle on an outside surface thereof.

18. The vacuum cleaner as claimed in claim 1, further comprising a liquid sprayer provided in an interior of the dust collecting box, the liquid sprayer having a spray button provided at a top portion thereof, the spray button being connected to a press button through the upper cover.

19. The vacuum cleaner as claimed in claim 18, further comprising a mounting part that couples the liquid sprayer to an interior wall of the dust collecting box facing the filter assembly, the mounting part comprising:

an attachment portion that is positioned against and coupled to the interior wall of the dust collecting box;

a supporting plate that extends outward from a lower end of the attachment portion so as to support a lower end of the liquid sprayer thereon; and at least one elastic arm that extends outward from a central portion of the attachment portion so as to releasably couple the liquid sprayer to the mounting part.

20. The vacuum cleaner as claimed in claim 19, wherein the liquid sprayer comprises:

a cylindrical body that is supported by the supporting plate and held by the at least one elastic arm, wherein the cylindrical body receives and stores fluid therein; and a nozzle oriented toward a central portion of the dust collecting box and in communication with an interior of the cylindrical body, wherein the nozzle sprays fluid from the cylindrical body into the dust collecting box in response to an actuation of the spray button by the press button.

21. A vacuum cleaner, comprising:

a suction device provided in a body of the vacuum cleaner that provides suction force;

a handle provide at an upper portion of the body;

a suction nozzle that draws in particle laden air using the suction force provided by the suction device;

a dust collecting box that receives the particle laden air drawn in by the suction nozzle;

an upper cover having an opening in an upper surface thereof that selectively opens and closes an upper portion of the dust collecting box;

a filter assembly that is removably coupled to an edge of the opening in the upper cover, wherein the filter assembly filters particles from the particle laden air and discharges remaining air upward, and wherein the filter assembly is configured to be inserted into the dust collecting box from a space above the upper cover through the opening in the upper cover, and to be withdrawn from the dust collecting box into the space above the upper cover through the opening in the upper cover;

a supporting member that extends upward from a bottom of the dust collecting box, the supporting member having a hinge shaft provided at a top surface thereof;

a separation plate including a pair of semicircular plates, wherein mating edges of the pair of semicircular plates are rotatably coupled to the hinge shaft so as to rotate about the hinge shaft and selectively divide an interior space of the dust collecting box into an upper space and a lower space; and a partition plate positioned between the separation plate and the bottom of the dust collecting box so as to prevent circulation of air in the lower space.

* * * * *